US007574999B2

(12) United States Patent
Pardoski, Jr.

(10) Patent No.: US 7,574,999 B2
(45) Date of Patent: Aug. 18, 2009

(54) BOW STRING RELEASE

(76) Inventor: Joseph M. Pardoski, Jr., 716 Elk Creek Rd., Myers Flat, CA (US) 95554

( * ) Notice: Subject to any disclaimer, the term of this patent is extended or adjusted under 35 U.S.C. 154(b) by 319 days.

(21) Appl. No.: 11/503,621

(22) Filed: Aug. 14, 2006

(65) Prior Publication Data

US 2008/0035135 A1 Feb. 14, 2008

(51) Int. Cl.
*F41B 5/18* (2006.01)

(52) U.S. Cl. ..... 124/35.2

(58) Field of Classification Search ..... 124/35.2
See application file for complete search history.

(56) References Cited

U.S. PATENT DOCUMENTS

| | | | | |
|---|---|---|---|---|
| 228,302 | A * | 6/1880 | Beard | 124/35.2 |
| 5,025,771 | A | 6/1991 | Hanson | |
| 5,247,922 | A | 9/1993 | Lalonde | |
| 5,546,924 | A * | 8/1996 | Todd | 124/35.2 |
| 5,653,213 | A | 8/1997 | Linsmeyer | |
| 5,850,825 | A * | 12/1998 | Scott | 124/35.2 |
| 6,032,661 | A | 3/2000 | Goff et al. | |
| 6,460,529 | B2 | 10/2002 | Pullin | |
| 6,478,020 | B1 * | 11/2002 | Rentz | 124/35.2 |
| 6,481,430 | B1 | 11/2002 | Lightcap, Jr. | |
| 6,712,056 | B2 * | 3/2004 | Omi | 124/20.1 |
| 6,957,644 | B2 * | 10/2005 | Simo et al. | 124/35.2 |
| 2002/0104522 | A1 * | 8/2002 | Pullin | 124/35.2 |

* cited by examiner

*Primary Examiner*—John Ricci
(74) *Attorney, Agent, or Firm*—Dale J. Ream

(57) ABSTRACT

A bow string release includes a retention portion having an interior area for containing a portion of a bow string and a barrier for selectively separating the interior area from an area external thereto. The barrier is movable from an open configuration in which the bow string may pass between the interior and external areas and a closed configuration in which the bow string may not pass between the interior and external areas. The bow string release includes an actuating portion having a trigger operatively coupled to the barrier for selectively moving the barrier between the open and closed configurations. The actuating portion includes a trigger guard for protecting the trigger from being accidentally actuated. The retention portion includes a trigger lock for selectively restricting movement of the trigger and barrier, the barrier being immovable from the closed configuration when the trigger lock is activated.

5 Claims, 4 Drawing Sheets

BOW STRING RELEASE

BACKGROUND OF THE INVENTION

The present invention relates to bow hunting accessories and, more particularly, to a bow string release for selectively retaining or releasing a bow string. The bow string release includes a trigger guard for protecting the trigger from accidental movement, and a trigger lock ("safety") for selectively preventing movement of the trigger.

Bow hunters often use a bow release to hold a bow string drawn back while hunting. Then, when an arrow is placed against the string and the hunter is ready to take a shot, the bow release is manipulated to release the string. Bow release devices are advantageous in that they provide a more sure grip of a bow string for the hunter as well as protecting a hunter's fingers from soreness that may be experienced when pulling and holding a bow string.

Various devices have been proposed in the art for pulling, holding, and releasing a bow string. Although assumably effective for their intended uses, the existing bow release devices are often triggered unintentionally in that their release triggers may be actuated if the trigger is accidentally depressed by contact with the hunter's fingers, with a tree branch, or some other object.

Therefore, it would be desirable to have a safety bow string release that includes a guard for preventing unintentional contact with the trigger of a bow release. Further, it would be desirable to have a bow string release that includes a "safety" mechanism that selectively prevents movement altogether—even intentional movement—of a bow string release trigger. In addition, it would be desirable to have a safety bow string release that increases the safety of hunters while hunting with a bow.

SUMMARY OF THE INVENTION

A bow string release according to the present invention includes a retention portion having an interior area for containing a portion of a bow string. The retention portion also includes a barrier for selectively separating the interior area from an area external to the retention portion, the barrier being movable from an open configuration in which the bow string may pass between the interior area and the external area and a closed configuration in which the bow string may not pass between the interior and external areas.

The bow string release includes an actuating portion having a trigger operatively coupled to the barrier and being selectively movable in an imaginary plane for selectively moving the barrier between the open and closed configurations. The actuating portion also includes a trigger guard extending about the trigger along the imaginary plane to protect the trigger from being accidentally actuated. The retention portion also includes a trigger lock for selectively restricting movement of the trigger and barrier, the barrier being immovable from the closed configuration when the trigger lock is activated.

Therefore, a general object of this invention is to provide a bow string release for drawing, holding, and releasing a string of a bow.

Another object of this invention is to provide a bow string release, as aforesaid, having a trigger guard for protecting a trigger of the bow string release from inadvertent contact with a hunter's fingers, clothing, tree branches, or other objects.

Still another object of this invention is to provide a bow string release, as aforesaid, having a safety for selectively preventing actuation, even intentional, of the trigger of the bow string release.

Yet another object of this invention is to provide a bow string release, as aforesaid, having needle rollers for reducing friction on the bow string as it is released.

A further object of this invention is to provide a bow string release, as aforesaid, having a D-ring coupling for quick, efficient, and releasable attachment to a wrist harness.

A still further object of this invention is to provide a bow string release, as aforesaid, that is easy to use and economical to manufacture.

Other objects and advantages of the present invention will become apparent from the following description taken in connection with the accompanying drawings, wherein is set forth by way of illustration and example, embodiments of this invention.

DESCRIPTION OF THE PREFERRED EMBODIMENT

Figure 1:
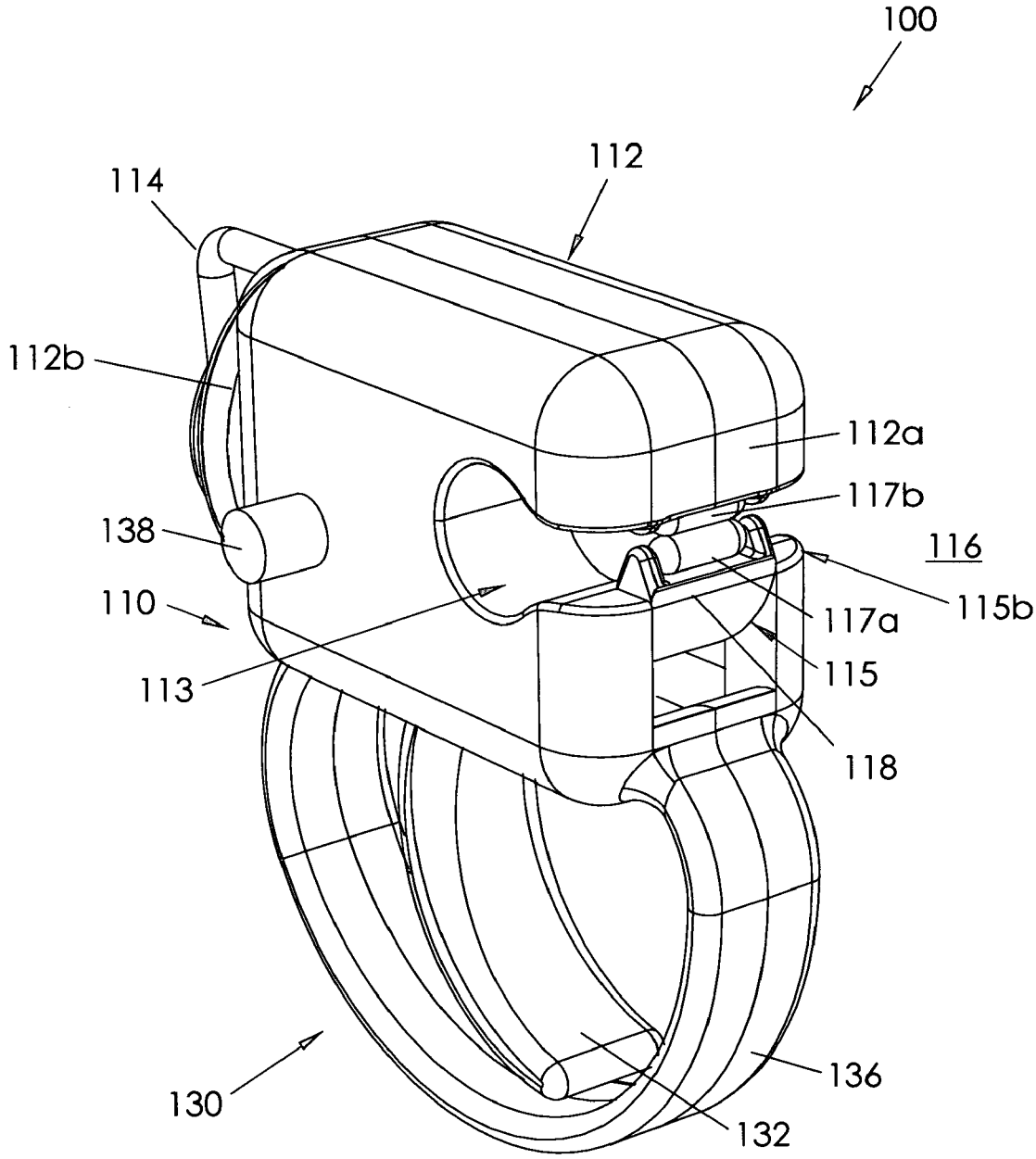
FIG. 1 is a perspective view of a bow string release according to a preferred embodiment of the present invention.

A bow string release 100 for use with a bow having a bow string (not shown) according to the present invention will now be described in detail with reference to FIGS. 1 through 4*d* of the accompanying drawings. More particularly, a bow string release 100 according to the current invention includes retention and actuating portions 110, 130.

As shown in FIGS. 1 through 3*b*, the retention portion 110 may include a housing 112 defining an interior area 113 for selectively containing a portion of the bow string (not shown). The housing 112 may have front and rear ends 112*a*, 112*b*, and the interior area 113 may be defined at the front end 112*a*. An harness anchor 114 may be coupled to the housing 112 at the rear end 112*b*. The housing 112 may be constructed from metal, composite, or another light-weight material having a high tensile strength.

A barrier 115 selectively separates the interior area 113 from an area 116 that is external to the housing 112. As shown in FIGS. 2*a* through 3*b*, the barrier 115 is movable from an open configuration 115*a* (FIGS. 2*a* and 3*a*) in which the bow string may pass between the interior area 113 and the external area 116 and a closed configuration 115*b* (FIGS. 2*b* and 3*b*) in which the bow string may not pass between the interior area 113 and the external area 116. A first needle roller 117*a* may be rotatably coupled to an upper end 118 of the barrier 115, and a second needle roller 117*b* may be rotatably coupled the housing 112 adjacent the first needle roller 117*a* when the barrier 115 is at the closed configuration 115*b*.

Figure 2A:
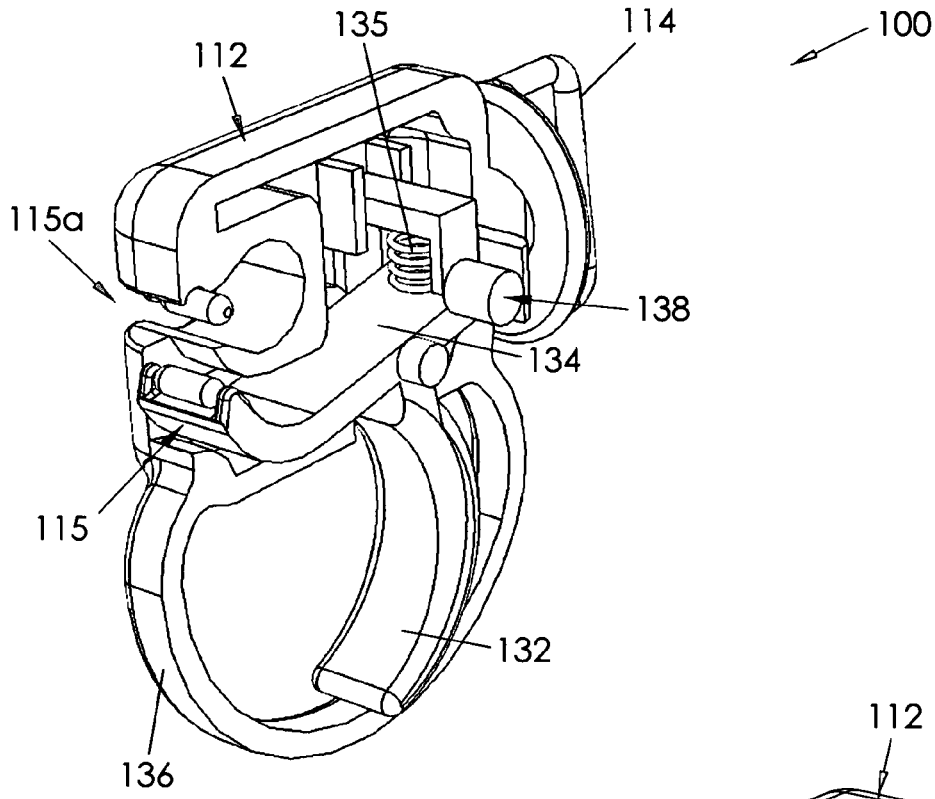
FIG. 2*a* is a perspective view of the bow string release as in FIG. 1 with a side wall of a housing removed and the barrier shown in an open configuration.
Figure 2B:
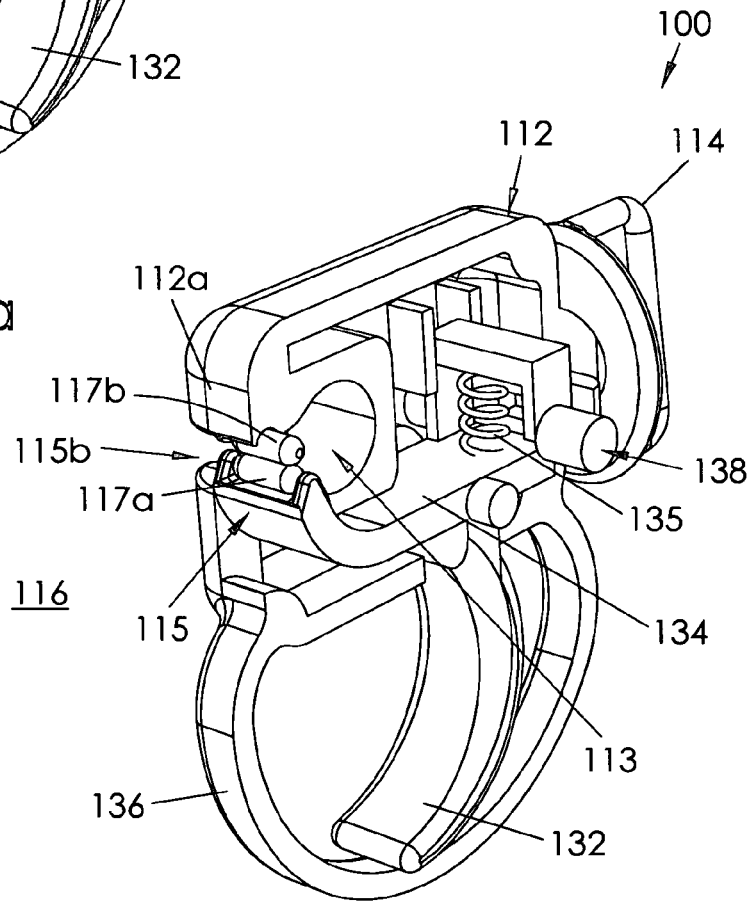
FIG. 2*b* is perspective view of the bow string release as in FIG. 2*a* with the barrier shown in a closed configuration.

The actuating portion 130 includes a trigger 132 operatively coupled to the barrier 115. As shown in FIGS. 2*a* through 3*b*, an extension 134 inside the housing 112 may be coupled to the barrier 115 and extend toward the rear end 112*b* of the housing 112, and the trigger 132 may be coupled to the extension 134. The extension 134, the barrier 115, and the trigger 132 may form a unitary pivotable member (as shown in FIGS. 2*a* through 3*b*), or the extension 134, the barrier 115, and the trigger 132 may otherwise be associated to perform as described. The trigger 132 is selectively movable for selectively moving the barrier 115 between the open and closed configurations 115*a*, 115*b*. More particularly, the trigger 132 may be selectively movable (i.e., rotatable) in an imaginary plane (not shown) for selectively moving the barrier 115 between the open and closed configurations 115*a*, 115*b*. A spring 135 may interact with the extension 134 to bias the barrier 115 to the closed configuration 115*b* (FIG. 2*b*).

A trigger guard 136 may extend from the housing 112 and around the trigger 132 to protect the trigger 132 from accidental movement. More particularly, the trigger guard 136 may extend about the trigger 132 along the imaginary plane to protect the trigger from accidental movement, and the trigger 132 may be completely encircled in the imaginary plane by the trigger guard 136 and the housing 112.

Figure 3A:
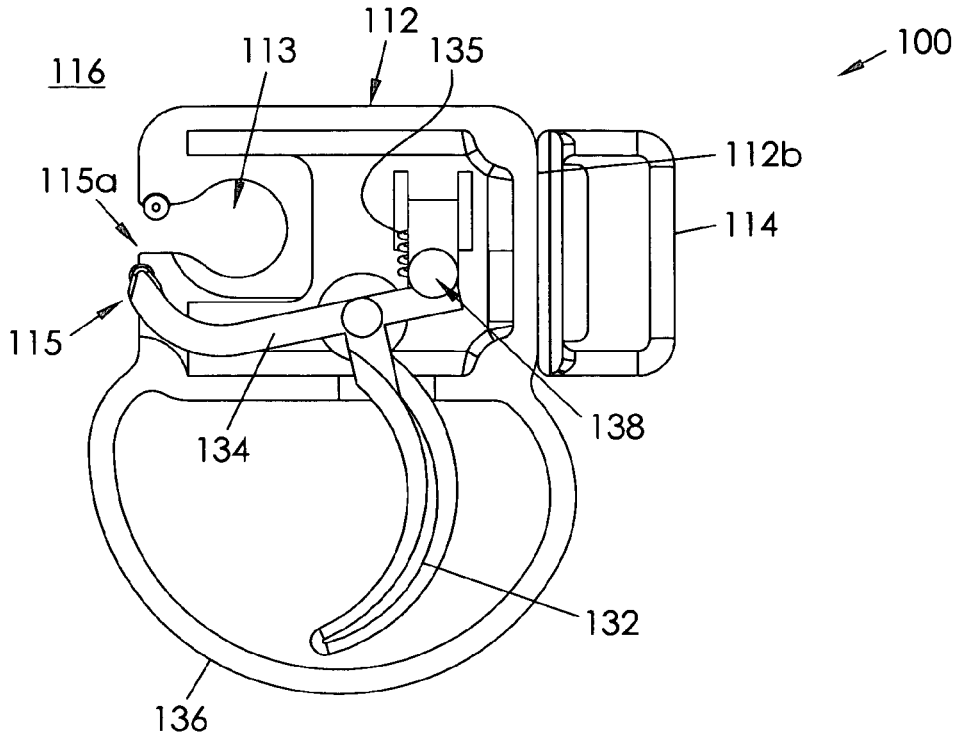
FIG. 3*a* is a side view of the bow string release as in FIG. 2*a;*
Figure 3B:
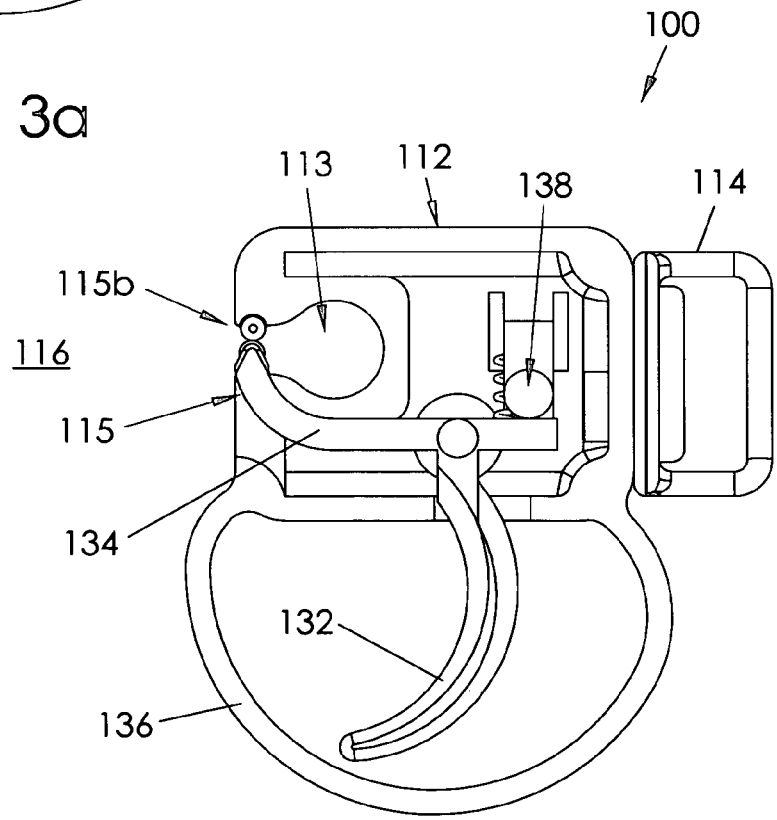
FIG. 3*b* is a side view of the bow string release as in FIG. 2*b;*
Figure 4A:
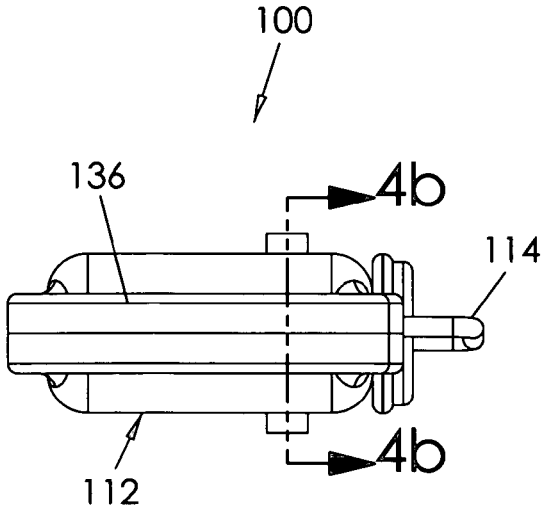
FIG. 4*a* is a top view of the bow string release as in FIG. 1.
Figure 4B:
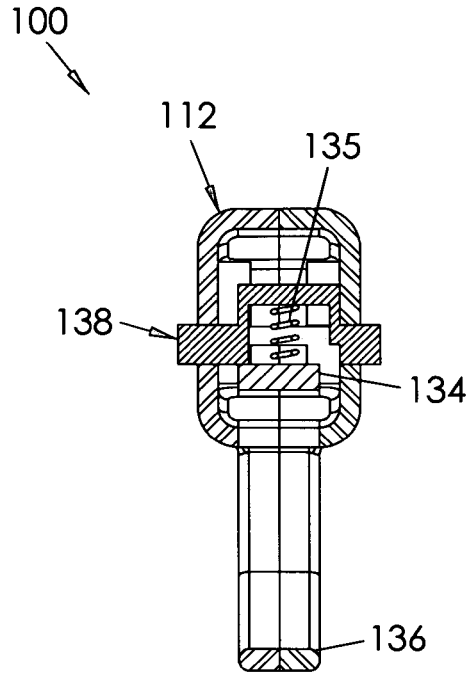
FIG. 4*b* is a sectional view taken along line 4*b*-4*b* of FIG. 4*a*, illustrating a trigger lock in a locked configuration restricting movement of the trigger.
Figure 4C:
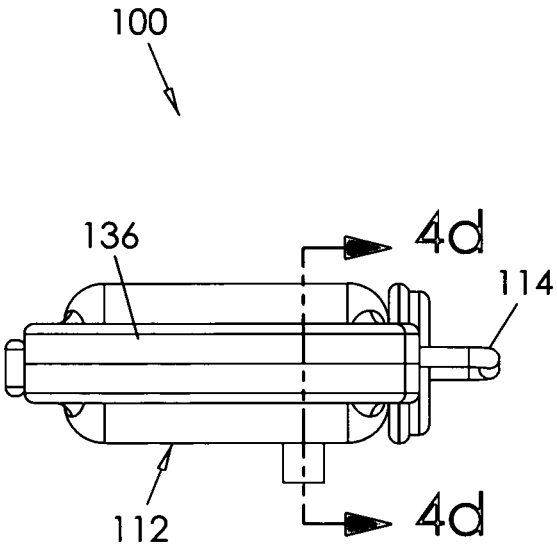
FIG. 4*c* is a top view of the bow string release as in FIG. 1.
Figure 4D:
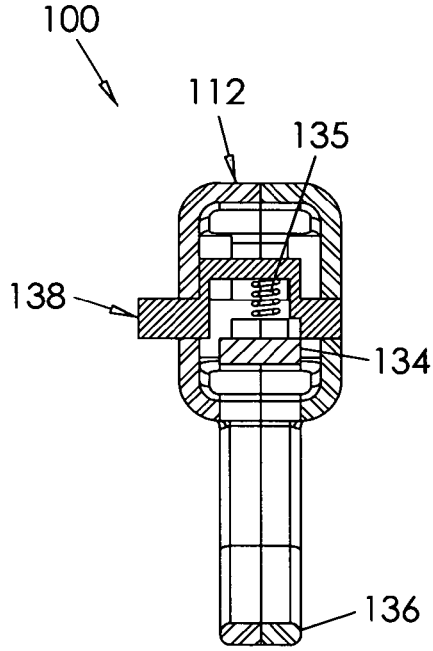
FIG. 4*d* is a sectional view taken along line 4*d*-4*d* of FIG. 4*c*, illustrating the trigger in an unlocked configuration allowing movement of the trigger.

A trigger lock 138 may selectively restrict the movement of the trigger 132, the barrier 115, and the extension 134 by abutting the extension 134 (FIGS. 3*b* and 4*b*) and/or the trigger 132 (not shown). When the trigger lock 138 is activated (i.e., when the trigger lock 138 abuts the extension 134), the barrier 115 is immovable from the closed configuration 115*b* (FIGS. 2*b*, 3*b*, and 4*b*). On the other hand, when the trigger lock 138 is not activated (e.g. when the trigger lock 138 is displaced from the extension 134 and extends outwardly), the barrier 115 is movable from the closed configuration (FIGS. 2*a*, 3*a*, and 4*d*).

In use, a harness (not shown) may be worn on a user's hand and attached to the harness anchor 114. The trigger 132 may be pressed, causing the barrier 115 to move to the open configuration 115*a* (FIGS. 2*a* and 3*a*) from the closed configuration 115*b* (FIGS. 2*b* and 3*b*). The bow string (not shown) may be placed in the interior area 113 from the external area 116, and the trigger 132 may be released. Once the trigger 132 is released, the spring 135 may cause the barrier 115 to move from the open configuration 115*a* (FIGS. 2*a* and 3*a*) to the closed configuration 115*b* (FIGS. 2*b* and 3*b*). The trigger lock 138 may be activated (i.e., moved to abut the extension 134 as shown in FIG. 4*b*), locking the barrier 115 at the closed configuration 115*b*. An arrow may be placed on the bow string, and the bow string may be pulled to ready the bow for shooting the arrow. The harness may alleviate some of the forces on the hand that would otherwise be encountered in pulling the bow string. When the user is prepared to shoot the arrow, the trigger lock 138 may be deactivated (moved to no longer abut the extension 134 as shown in FIG. 4*d*) and the trigger 132 may be pulled. The trigger guard 136 may ensure that the trigger 132 is not accidentally pulled once the trigger lock 138 is deactivated, and the trigger guard 136 may prevent the trigger 132 from pinching the user's hand when pulled. When the trigger 132 is pulled, the barrier 115 is moved from the closed configuration 115*b* to the open configuration 115*a* and the bow string is allowed to exit the interior area 113. The needle rollers 117*a*, 117*b* may reduce the friction associated with the bow string exiting the interior area 113. Once the trigger 132 is released, the spring 135 may again cause the barrier 115 to move from the open configuration 115*a* to the closed configuration 115*b*.

It is understood that while certain forms of this invention have been illustrated and described, it is not limited thereto except insofar as such limitations are included in the following claims and allowable functional equivalents thereof.

What is claimed is as follows:

1. A bow string release for use with a bow having a bow string, the bow string release comprising:
   - a housing having front and rear ends and defining an interior area at said front end for selectively containing a portion of the bow string;
   - a barrier for selectively separating said interior area from an area external to said housing, said barrier being movable from an open configuration in which the bow string may pass between said interior area and said external area and a closed configuration in which the bow string may not pass between said interior area and said external area;
   - an extension coupled to said barrier, said extension being inside said housing and extending toward said rear end of said housing;
   - a trigger coupled to said extension and being selectively movable for selectively moving said barrier between said open and closed configurations;
   - a trigger guard extending from said housing and around said trigger to protect said trigger from accidental movement;
   - a trigger lock selectively restricting movement of said trigger, said barrier, and said extension by abutting at least one item selected from the group consisting of said trigger and said extension, wherein said barrier is immovable from said closed configuration when said trigger lock is activated; and
   - a spring that interacts with said extension to bias said barrier to said closed configuration.

2. The bow string release of claim 1, further comprising a first needle roller rotatably coupled to an upper end of said barrier.

3. The bow string release of claim 2, further comprising a second needle roller rotatably coupled to said housing adjacent said first needle roller when said barrier is at said closed configuration.

4. The bow string release of claim 1, wherein a harness anchor is coupled to said housing at said rear end.

5. The bow string release of claim 1, wherein:
   - said trigger is selectively movable in an imaginary plane; and
   - said trigger is completely encircled in said imaginary plane by said trigger guard and said housing.

* * * * *